US005822819A

United States Patent [19]

Ferragut et al.

[11] Patent Number: 5,822,819

[45] Date of Patent: Oct. 20, 1998

[54] ULTRASONIC WATER LEVEL DETECTION SYSTEM FOR USE IN A WASHING MACHINE

[75] Inventors: Nelson J. Ferragut, Williamsburg; Michael A. Estenson, Ely; J. Scott Petty, Cedar Rapids, all of Iowa

[73] Assignee: Raytheon Appliances Inc., Ripon, Wis.

[21] Appl. No.: 864,534

[22] Filed: May 28, 1997

[51] Int. Cl.[6] ..... D06F 33/02

[52] U.S. Cl. ..... 8/158; 68/12.05; 68/12.21

[58] Field of Search ..... 8/158; 68/12.05, 68/12.21, 207; 137/387; 250/339.11, 341.8, 357.1

[56] References Cited

U.S. PATENT DOCUMENTS 5,305,485 4/1994 Getz et al. ..... 8/158

5,515,565 5/1996 Maddix et al. ..... 8/158

*Primary Examiner*—Philip R. Coe

*Attorney, Agent, or Firm*—Leydig, Voit & Mayer, Ltd.

[57] ABSTRACT

A water level detection system and method for automatically controlling in real time the water height in a washing machine to assure the optimum operating level. An ultrasonic transceiver generates a plurality of ultrasonic pulses and detects the corresponding echoes. A microprocessor stores a plurality of ranging signals representing the time period between the ultrasonic pulse and the detection of the corresponding echo. A set of the ranging signals forms a mathematical or graphic signature which changes as the water level rises up through the clothes in the washing machine. The microprocessor detects when a predetermined characteristics occurs in this signature and sends a signal to the standard washing machine controls to stop the flow of water.

23 Claims, 4 Drawing Sheets

ULTRASONIC WATER LEVEL DETECTION SYSTEM FOR USE IN A WASHING MACHINE

FIELD OF THE INVENTION

This invention relates to a water level detection system and method for automatically controlling in real time the water height in a washing machine to assure the optimum level for a proper wash cycle. In particular, the system uses an ultrasonic transceiver to generate a plurality of ultrasonic pulses and to detect the echoes. The system monitors the signature of these ultrasonic pulse echoes which changes as the water level rises up through the clothes in the washing machine. The system turns off the water input to the washing machine when a predetermined characteristic occurs in the signature of the ultrasonic pulse echoes.

BACKGROUND OF THE INVENTION

In washing machines it is important that the level of the water just covers the clothes placed inside the tub. If the water level is too low there will be insufficient water and the clothes will not be properly cleaned. If the water level is too high then water which is becoming increasingly expensive is wasted. In most washing machines the user places a load of clothes to be cleaned inside the tub and selects an appropriate water level by turning a knob or setting a switch on the control panel to low, medium or high. Clearly, this approach calls for guess work on the part of the user which frequently results in the water level being either too high or too low.

Other known systems use electronic circuits to detect certain characteristics and then use this information to calculate an appropriate water level. In one such system, the clothes are loaded into the tub or basket and a motor is repeatedly energized to rotate the basket. Between each energization of the motor the speed of the rotation of the agitator is determined and used to measure the clothes load quantity. An appropriate water level is then determined based upon the amount of clothes detected.

In another known system an ultrasonic transceiver is placed inside the washing machine. Ultrasonic pulses are directed towards the clothes. Ultrasonic echo pulses from the surface of the clothes are detected and used to determine the height of the clothes in accordance with the elapsed time between the transmission of the ultrasonic pulses and the receipt of the corresponding echoes. The basket or tub is rotated and a plurality of ultrasonic pulses generated and corresponding echoes received such that a plurality of clothes height values are calculated. An average clothes height is then calculated and the water level sufficient to cover the average clothes height is determined.

Each of these known systems attempts to determine the height or quantity of the clothes within the tub and then select the appropriate water level. It would be desirable to use ultrasound to detect when the water level has reached the appropriate level in real time.

SUMMARY OF THE INVENTION

A water level detection system and method determines when the water level in the tub of a washing machine covers the clothes and then shuts off the water input to the tub. An ultrasonic transceiver receives a signal from a microprocessor and generates a plurality of ultrasonic pulses directed into the tub of the washing machine. Ultrasonic pulse echoes are detected by the transceiver. A sensing circuit connected to the transceiver produces a low strength electrical signal in response to the ultrasonic pulse echoes. An amplifier and filter circuit increases the strength of this electrical signal within a preselected frequency range. The amplified and filtered signal is applied to a edge detector to identify signals occurring close together in time. Finally, the signal from the edge detector is applied to the microprocessor which calculates the signature of the ultrasonic pulse echoes and determines when this signature demonstrates a particular characteristic. Once the particular characteristic in the ultrasonic pulse echo signature is detected the microprocessor sends a signal to a standard washing machine control to shut off the water to the tub.

If the level of the water flowing into the tub of the washing machine exceeds the height of the clothes, the time between each of the ultrasonic pulses and the receipt of the corresponding ultrasonic pulse echoes will decrease in a linear manner. If clothes are present in the tub of the washing machine and water is being inputted, the time between each of the ultrasonic pulses and the receipt of the corresponding ultrasonic pulse echoes will be erratic or non-linear as the clothes shift or move within the tub due to the rising water level. The microprocessor calculates for a plurality of ultrasonic pulses the time between each ultrasonic pulse and the receipt of the corresponding ultrasonic pulse echo which is referred to as the ranging time. The ranging time for each ultrasonic pulse is used as a data point on a graph with the y-ordinate being the ranging time and the x-ordinate being the overall time. The microprocessor determines the best fit line common to a set of ranging time data points and determines the slope of the best fit line. The microprocessor now uses a least squares fit methodology or algorithm to determine the sum of the squares of the errors between the data points in the set and the best fit line. The microprocessor compares the sum of the squares of the errors to a predetermined value. If the sum of the squares of the errors is below the predetermined value, then the set of data points is sufficiently close to the best fit line to indicate substantial linearity which means that the level of the water is changing in a regular or constant gradual manner. Now, the microprocessor compares the slope of the best fit line to a predetermined value. If the slope is below the predetermined value, then the level of the water is raising or the ranging time is decreasing. Of course, the slope of the line will be negative and the more negative the slope the faster the water is raising. If both conditions are satisfied, then the microprocessor sends a signal to the standard washing machine controls to shut off the input of water. If either the sum of the squares of the errors or the slope of the best fit line is not below the respective predetermined values then another ranging data point is determined and included in the set of data points and the oldest data point in the set is removed. Now, a new best fit line is calculated and the slope of the new best fit line is determined and again using the least squares fit methodology, the sum of the squares of the errors between the data points in the new set is calculated. The appropriate comparisons as described above are again made and the above process repeated until both the sum of the squares of the errors and the slope are below their respective predetermined values and the water input is shut off.

The collection of ranging data points is referred to as the signature of the ultrasonic pulse echoes. The characteristics of the signature of the ultrasonic pulses that indicates the water level is above the level of the clothes is the sum of the squares of the errors between the data points in the set and the best fit line, and the slope of the best fit line both being below predetermined values. However, other characteristics of the signature of the ultrasonic pulses could either singularly or in combination be used as the indicating characteristic.

In an alternative embodiment of the present invention, the step of comparing the slope of the best fit line to the predetermined value is omitted. In this embodiment the characteristic of the signature of the ultrasonic pulse echoes that indicates that the level of the water is at the optimum operating level is only the sum of the square of the errors being below the predetermined value.

In another alternative embodiment of the present invention, the step of comparing the sum of the squares of the errors to the predetermined value is omitted. In this embodiment the characteristic of the signature of the ultrasonic pulse echoes that indicates that the level of the water is at the optimum operating level is only the slope of the best fit line being below the predetermined value.

Figure 1A:
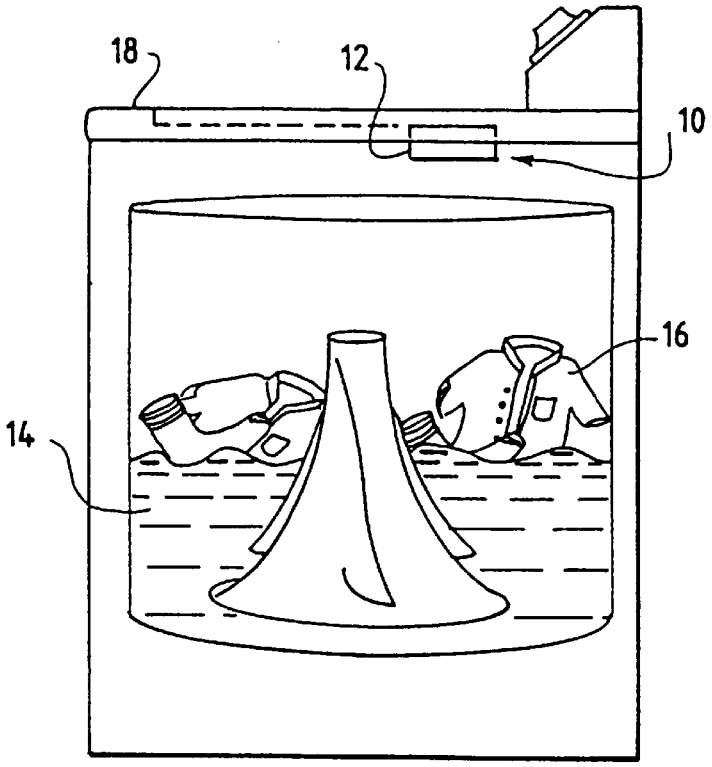
FIG. 1*a* is a representative diagram of a washing machine using the water level detection system of the present invention with the level of the water not yet covering the clothes.

While the invention is susceptible to various modifications and alternative forms, a specific embodiment thereof is shown by way of example in the drawings and will herein be described an detail. It should be understood, however, that it is not intended to limit the invention to the particular forms disclosed. On the contrary, the invention is to cover all modifications, equivalents, and alternatives falling within the scope of the invention as defined by the appended claims.

DETAILED DESCRIPTION OF THE INVENTION

Figure 1B:
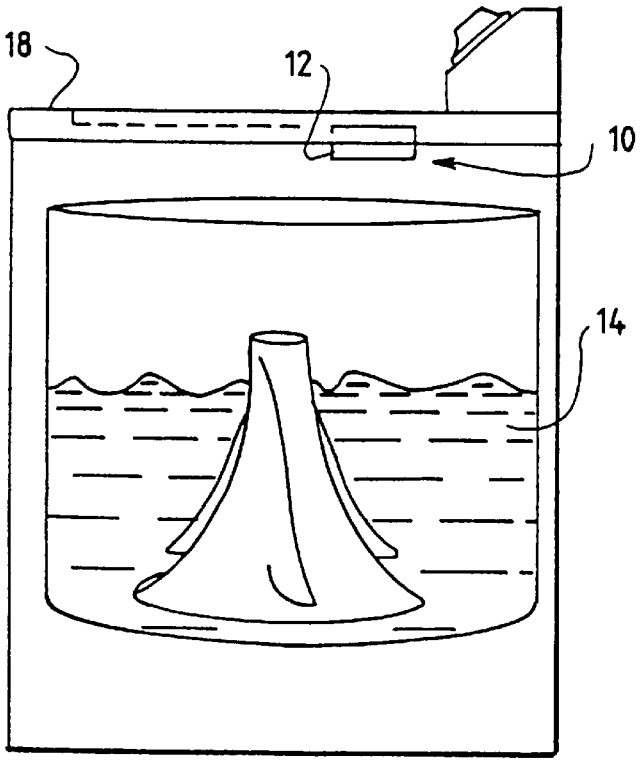
FIG. 1*b* is a representative diagram of a washing machine using the water level detection system of the present invention with the level of the water covering the clothes.

A water level detection system 10 of the present invention as used in a washing machine is illustrated in FIG. 1*a*. The detection system 10 determines in real time when the water level in the tub of the washing machine is above the level of the clothes to be cleaned. The detection system 10 comprises a transceiver 12 which generates a plurality of ultrasonic pulses towards the surface of the water 14 and the clothes 16. The detector 10 is shown attached to lid 18 of the washing machine. However, the detector 10 can be positioned at any location inside the washing machine as long as it is sufficiently separated from the water and clothes so that it can transmit and receive reflected ultrasonic pulses without interference. FIG. 1*a* illustrates the tub of the washing machine filling with water but the water is not yet covering the clothes 16. FIG. 1*b* illustrates the washing machine tub as the water 14 is just covering the clothes 16.

Figure 2:
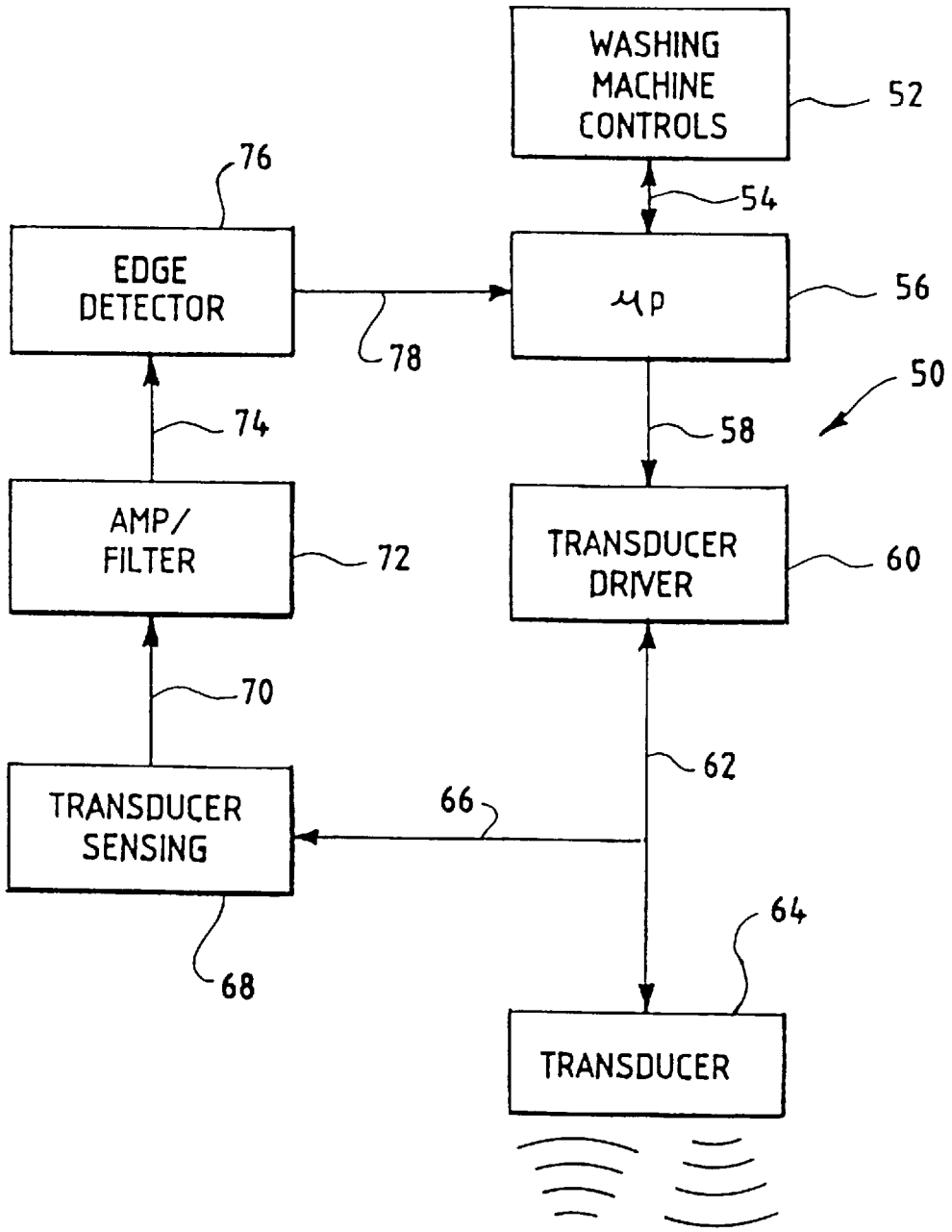
FIG. 2 is a block diagram of the water level detection system of the present invention connected to the standard controls of a washing machine.

FIG. 2 is a block diagram of the water level detection system 50 of the present invention connected to the controls 52 of a typical washing machine. The controls 52 are well known to one of ordinary skill in the field and accordingly not shown in detail. The controls 52 provide a start signal over lines 54 to begin the operation of the water level detection system 10. Furthermore, the controls 52 receive a signal from the water level detection system 50 to turn off the water to the washing machine when the optimum level is reached. The optimum water level is just over that which completely covers the clothes placed inside the tub of the washing machine. If the water level is too low and doesn't completely cover the clothes then there will not be sufficient water to properly clean the clothes. If the water level is too high and completely covers the clothes by an excessive amount then water will be wasted during the wash cycle.

The start signal from the control 52 on lines 54 is received by a microprocessor 56. Any microprocessor or microcontroller which can perform the functions and calculations described hereinafter can be used and the selection and programming of such a microprocessor is within the abilities of one of ordinary skill in the field. In the preferred embodiment of the water level detection system 50 a Microchip Technology Inc. PIC 16 C54A microprocessor is used.

Microprocessor 56 sends a signal, in the preferred embodiment a square wave signal ranging from 0 to 5 volts, on line 58 to a transducer driver circuit 60. The square wave signal is converted by the transducer driver circuit 60 to a high voltage signal, in the preferred embodiment 400 volts. The transducer driver circuit 60 sends the 400 v. signal over line 62 to a transceiver 64 and over line 66 to a transducer sensing circuit 68 as described further below. In response to the 400 v. signal the transceiver 64 generates an ultrasonic pulse directed towards the bottom of the tub of the washing machine.

The ultrasonic pulse rebounds or echoes back towards the transceiver 64. The amount of time that it takes the echo signal to reach the transceiver 64 relates to the distance between the transceiver 64 and the object that the ultrasonic pulse strikes. The amount of time between the transmission of the pulse and the receipt of the echo is commonly referred to as the ranging time. The echo signal detected by the transceiver 64 is a very weak signal in the range of 10 millivolts and is sent via line 66 to the transducer sensing circuit 68. As indicated above, the transducer sensing circuit 68 is also connected to the transducer driver circuit 60 and receives the 400 v. signal via line 66. The transducer sensing circuit 68 blocks the 400 v. signal on line 66 but allows the weak echo signal on line 66 to pass. The transducer sensing circuit 68 sends the weak echo signal via line 70 to a amplifier-filter circuit 72. The weak echo signal is increased and unwanted distortions or noise is removed by the amplifier-filter circuit 72. The amplified echo signal is sent via line 74 to a edge detector circuit 76. A sudden increase in the amplified echo signal is picked up by edge detector circuit 76 and sent via line 78 to the microprocessor 56.

In the preferred embodiment, the microprocessor 56 stores the ranging time for a set of nine echo signals. Of course, more or less than nine echo signals can form the set. The ranging time for each ultrasonic pulse forms a data point which is plotted on a graph with the y-ordinate being the ranging time and the x-ordinate being the overall time. The ranging times for the set of nine echo signals form a signature. As the water fills the tub of the washing machine the clothes shift in position and the ranging time or the time between the transmission of the pulse and the receipt of the echo by the transceiver 64 varies. Accordingly, as the water level raises up through the clothes the signature of the set of echo pulses cannot be plotted as a straight line. If the water has risen to a level above the clothes then the signature of the set of echo pulses, in mathematical theory, can be plotted as a straight line. In practice, however, there will be a slight deviation of each data point from an ideal mathematical straight line since the surface of the water in the tub is not absolutely smooth. In order to accommodate this practical problem, the microprocessor uses the set of data points to calculate the best fit line and the slope of the best fit line using a well known mathematical procedure within the ability of one of ordinary skill in the art. The best fit line is the line that comes the closest to having each data point on the line realizing that some or all of the data points may be slightly displaced from the line. The distance each data point is displaced or off the best fit line is referred to as the error. Now, using another mathematical procedure, commonly known as the least squares fit the microprocessor 56 determines the sum of the errors or the sum of the distance that each data point is displaced or off the best fit line. If the sum of the errors from the least squares fit procedure is below a predetermined value, the set of data points are sufficiently close to the best fit line to indicate that the data points form a straight line and accordingly the water level is above the clothes. If the sum of the errors from the least squares fit procedure is above the predetermined value the set of data points are sufficiently removed from the best fit line to indicate that the data points are erratic and accordingly the water level is not above the clothes. If the sum of the errors is above the predetermined value another data point is added to the set, the oldest data point is removed and the above procedure repeated. If the sum of the errors is below the predetermined value, the microprocessor compares the slope of the best fit line to a predetermined value. If the slope of the best fit line is above the predetermined value, the water level in the tub is not rising and the process of selecting a new data point is repeated. If the slope of the best fit line is below the predetermined value, the water level is rising and the microprocessor 56 sends a signal to the washing machine controls 52 to shut off the water.

In an alternative embodiment of the invention, the step of comparing the slope of the best fit line to the predetermined value or comparing the sum of the errors to the predetermined value is omitted. These embodiments while not as accurate as the preferred embodiment using the comparison of both the sum of the errors and the slope of the best fit line to predetermined values is sufficient in some circumstances to determine when the level of the water is at the optimum operating level. It is within the scope of the present invention that in addition to the above alternative embodiments, other characteristics of the signature of the ultrasonic echo pulses either singularly or in combination can be used as the characteristic indicating that the water level is at the optimum level.

Figure 3:
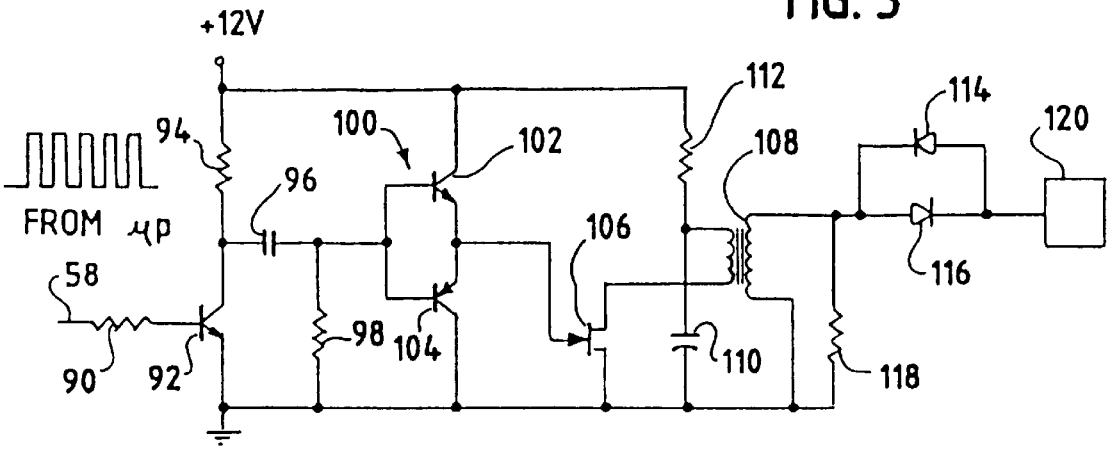
FIG. 3 is a schematic diagram of the transducer driving circuit of the present invention.

FIG. 3 is a schematic of the transducer driving circuit 60. The 0 to 5 volt square wave signal on line 58 from microprocessor 56 passes through resistor 90 to limit the current. The current limited signal is applied to the base of transistor 92. The collector of transistor 92 is pulled up to 12 volts through resistor 94. When the square wave input signal is low, the transistor 92 is off, and the signal at the collector is at 12 volts. However, when the square wave input signal is high, the transistor 92 is on, and the signal at the collector is at ground. Accordingly, the 0 to 5 volt square wave input signal is converted to a 0 to 12 volt signal. A capacitor 96 prevents a high current if the square wave input signal stays high for a long period of time. A resistor 98 is connected at the output of capacitor 96 to prevent current if there is no signal. A push-pull amplifier 100 receives the 0 to 12 volt AC signal. The push-pull amplifier 100 comprises two transistors 102 and 104, respectively. When the signal at the bases of transistors 102 and 104 is high, transistor 102 is on or conducting and the signal at the emitter is high and transistor 104 is off. When the signal at the bases of transistor 102 and 104 is low. transistor 104 is on or conducting and the signal at the emitter is low and transistor 102 is off. Thus, the signal at the emitters of transistors 102 and 104 goes high and low in accord with the input, only with a higher current. A field effect transistor 106 is connected to the emitters of transistors 102 and 104 and to the input at the low side of a step-up transformer 108. The output signal from the push-pull amplifier 100 is applied to the field effect transistor 106 which turns on and off with enough power to drive current through the step-up transformer 108. A large capacitor 100, for example 1000 microfarads and a small resistor 112 are connected to the input at the high side of the transformer 108 to prevent excessive noise on the 12 volt signal caused by the input at the low side of the transformer being grounded through field effect transistor 106 and to provide additional current. Now, a high voltage pulse, for example 400 volts is present at the secondary winding of the step-up transformer 108. The 400 volt signal is applied to a pair of reverse facing diodes 114 and 116 respectively. The diodes 114 and 116 are reverse facing so that there has to be a 0.7 volt drop across the diodes for current to pass in either director. A resistor 118 dampens the signal. The output of the diodes 114 and 116 is a 400 volt pulse signal which is applied to the input of the transceiver 120. Upon receipt of the 400 volt pulse signal the transceiver generates an ultrasonic pulse at 225 kilohertz. Of course, other ultrasonic frequencies could be used.

Figure 4:
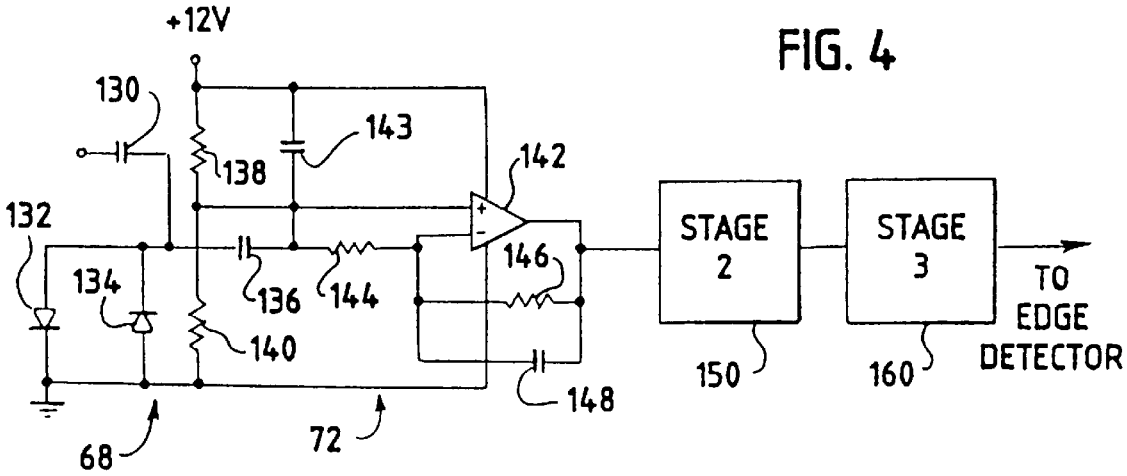
FIG. 4 is a schematic diagram of the transducer sensing and amplifier-filter circuit of the present invention.

FIG. 4 is a schematic diagram of the transducer sensing circuit 68 and the amplifier-filter circuit 72 as shown in FIG. 2. The echo pulse in the range of 1 to 20 millavolts is detected by the transceiver 120 and is applied to the capacitor 130 at the input to the transducer sensing circuit 68. A pair of reverse facing diodes 132 and 134 appear to be open circuits to the small echo pulse. Now, the 400 volt pulse output of the transducer drive circuit 60 is also applied to the input of capacitor 130. The diodes 132 and 134 clamp the 400 v. signal preventing it from going above 0.7 volts or below −0.7 volts. The AC voltage signal at the output of capacitor 130 is oscillating about ground or 0 volts. This signal is now applied to a capacitor 136 to offset the AC voltage causing it to oscillate about approximately 6 volts. A pair of resistors 138 and 140 act as a divider which produces a voltage at resistor 138 of 6 volts. This 6 volt signal is applied to one input of operational amplifier 142. A capacitor 143 is parallel with resister 138 stabilizes the 6 volt signal input to operational amplifier 142. The AC signal oscillating about 6 volts at the output of the capacitor 136 is applied to the other input of the operational amplifier 142. A capacitor 148 is in parallel with a resistor 146 to limit noise. The amplification factor is the resistance of the resistor 146 divided by the resistance of a resistor 144, in the preferred embodiment approximately 39. Thus, the signal at the output of the operational amplifier 142 is approximately 39 times the echo signal. The capacitor 136 and the resistor 146 also operate as a filter. If capacitor 136 is 100 picofarads and resistor 146 is 390 kilohms, then the filter amplifies a signal at 225 kilohertz more than a signal at any other frequency. In the preferred embodiment, 225 kilohertz is the frequency of the ultrasonic pulse and the echo. Now, the output of the operational amplifier 142 is applied to another stage 150 which is identical to that just described for amplifying the signal, in the preferred embodiment the amplification factor is 10. Stage 150 is shown in block diagram form for simplicity. The output of stage 150 is applied to a third stage 160 which is identical to the stage 150 and also shown in block diagram form for simplicity. The amplified and filtered signal output of stage 160 is applied to the input of edge detector 76.

Figure 5:
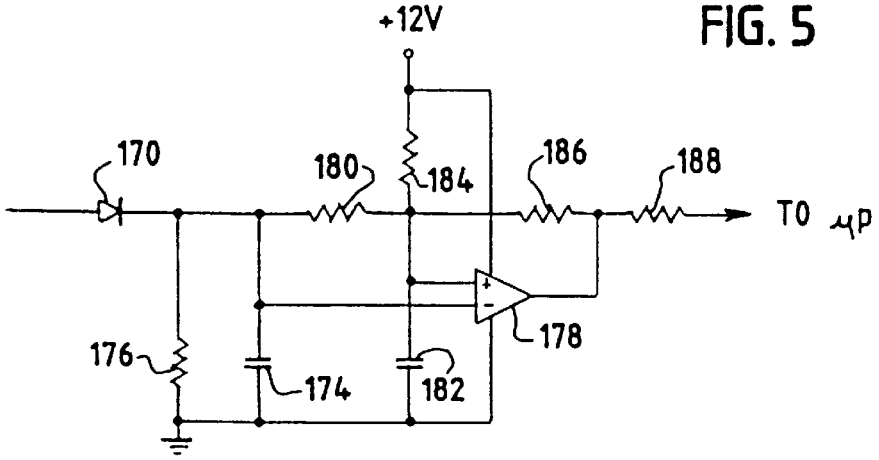
FIG. 5 is a schematic diagram of the edge detector of the present invention.

FIG. 5 is a schematic diagram of the edge detector 76. The amplified and filtered output AC echo signal from stage 160 is applied to a diode 170. When the AC echo signal is positive, current passes through diode 170 but when the AC echo signal is negative, no current passes. When current passes through diode 170 it charges capacitor 174 which subsequently discharges through a resistor 176. The signal at the capacitor 174 is applied to the negative input of a compacitor 178. A resistor 180 and a capacitor 182 form a low pass filter and receive the same signal as is applied to the negative input of the comparator 178. The low pass filter comprising the resister 180 and the capacitor 182 delays this signal due to the charging of capacitor 182. The delayed signal is applied to the positive input of the comparator 178 but with a resistor 184 causing the signal to be slightly offset from the signal at the negative input to the comparator 178. Thus, the comparator receives the envelope of the echo signal and the envelope of the echo signal delayed by a low pass filter to detect a sudden raise in the echo signal. If the signals, at the negative and positive inputs to the comparator 178, were exactly the same voltage a small amount of oscillation or noise on either one may cause the output to become unstable. A resistor 186 is a feedback resistor which increases the offset. The output of the comparator 178 passes through current limiting resistor 188 to the microprocessor 56.

Figure 6:
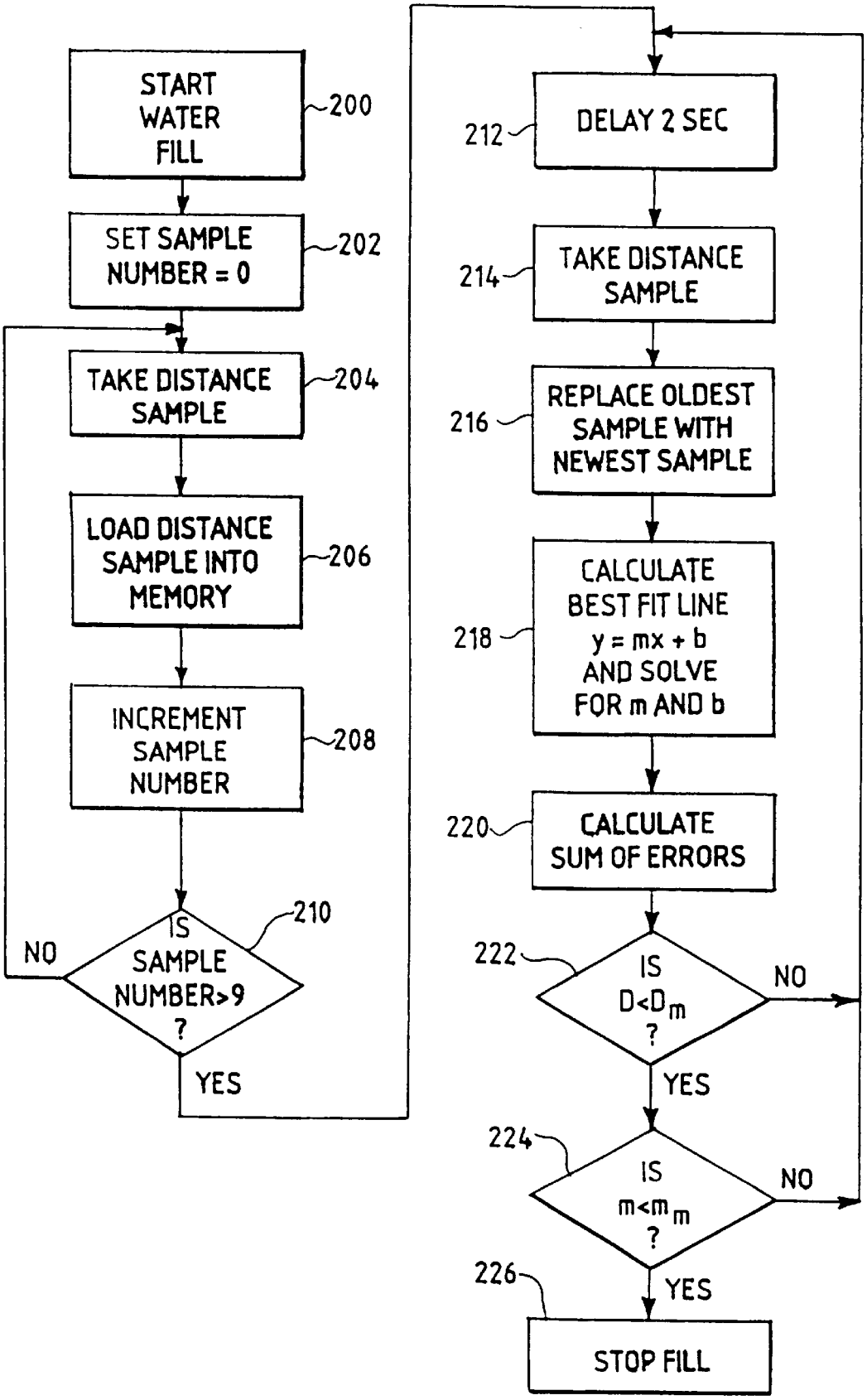
FIG. 6 is a flow chart of the operation of the washing machine under the water level detection system of the present invention.

FIG. 6 is a flow chart of the operation of the microprocessor 56. At step 200 the water detection system receives a signal from the standard washing machine control indicating that the process of filling the tub with water has begun. At step 202, the sample number is set equal to zero. At step 204, a range or distance sample is taken by having the microprocessor 56 through the transducer driver 60 cause the transceiver 64 send an ultrasonic pulse towards the bottom of the tub and receive the echo pulse which is passed through the transducer sensing circuit 68, the amplifier filter circuit 72 and the edge detector 76 as described in detail above. At step 206, the distance sample, the time period between the ultrasonic pulse and the receipt of the echo pulse, is stored in the memory of the microprocessor 56. Now, at step 208 the sample number is incremented. At step 210 the sample number is compared to a predetermined maximum sample number. In the preferred embodiment the maximum sample number is nine. However, it should be clear that any number which provides an adequate set of samples can be used. If the sample number is less than the maximum sample number then the process returns to step 204 to take another distance sample. This sequence is repeated until an appropriate set of distance samples are loaded into the memory of microprocessor 56. Once the sample number equals the maximum sample number then the process delays further operation for a predetermined time period at step 212. In the preferred embodiment the predetermined time period is two seconds, however, it should be clear that any time interval or period can be used. Now, at step 214 another distance sample is taken and this newest distance sample replaces the oldest distance sample in the microprocessor memory at step 216. Now, the set of distance samples are a set of p data points ($x_i$, $y_i$) where i=0 to p−1 and in the preferred embodiment p=9. The best fit line, y=mx+b, is determined at step 218 and the slope m calculated using a well known mathematical procedure. The sum of the squares of the errors between the data points and the best fit line is:

$$D = \sum_{i=0}^{p-1} (y_i - mx_i - b)^2$$

Now, the microprocessor solves the above equation for D at step 220. In order to minimize errors between the data points and the best fit line, the partial derivatives are set equal to zero:

$$\frac{\partial D}{\partial b} = -2\sum_{i=0}^{p-1} (y_i - mx_i - b) = 0$$

$$\frac{\partial D}{\partial m} = -2\sum_{i=0}^{p-1} (y_i - mx_i - b)x_i = 0$$

Therefore, $$m\sum_{i=0}^{p-1} x_i + b\sum_{i=0}^{p-1} = \sum_{i=0}^{p-1} y_i$$

$$m\sum_{i=0}^{p-1} x_i^2 + b\sum_{i=0}^{p-1} x_i = \sum_{x=0}^{p-1} x_i y_i$$

The following constants are defined as:

$$X_n = \sum_{i=0}^{p-1} x_i^n$$

and $$Y_n = \sum_{i=0}^{p-1} x_i^n y_i$$

The partial derivatives are simplified as:

$$mX_1 + bX_0 = Y_0$$

and $$mX_2 + bX_1 = Y_1$$

Now, the two unknowns m and b are solved for:

$$m = \frac{X_0Y_1 - X_1Y_0}{X_0X_2 - X_1^2}$$

and $$b = \frac{X_2Y_0 - X_1Y_1}{X_0X_2 - X_1^2}$$

If the data points are evenly spaced and sequential in time, the x coordinates are semi-arbitrarily pre-determined as follows:

$$x_i \epsilon \left\{ -\frac{p-1}{2}, -\frac{p-3}{2}, \ldots, \frac{p-3}{2}, \frac{p-1}{2} \right\}$$

If p=9 then $$X_0 = \sum_{i=0}^{8} x_i^0 = 9$$

$$X_1 = \sum_{l=0}^{8} x_i^1 = 0$$

-continued $$X_2 = \sum_{l=0}^{8} x_i^2 = 60$$

Therefore, $$m = \frac{9Y_1 - 0Y_0}{540} = \frac{Y_1}{60},$$

and $$b = \frac{60Y_0 - 0Y_1}{540} = \frac{Y_0}{9}$$

Now, the sum of the squares of errors D is calculated and compared to a predetermined value $D_m$. If the sum of the squares of errors D exceeds the predetermined value $D_m$ then the process returns to step 212. If the sum of the squares of errors is less than the predetermined value, the slope m is compared to a predetermined slope $m_m$ at step 224. If the slope m if greater than the predetermined slope $m_m$ then the process returns to step 212 and repeats the sequence. If the slope m is less than the predetermined slope $m_m$ then at step 226 the microprocessor sends a signal to the standard washing machine controls to stop the water filling the tub.

It will be understood that various changes in the details, arrangements and configurations of the parts and assemblies which have been described and illustrated above in order to explain the nature of the present invention may be made by those of ordinary skill in the art within the principle and scope of the present invention as expressed in the appended claims. It is not intended to limit the invention to the precise forms disclosed above and many modifications and variations are possible in light of the above teachings. An assembly language program listing for the Microchip microprocessor for performing the method of automatically detecting the water level in real time in accord with the present invention follows:

Copyright 1997 © Amanda Refrigeration, Inc.
All Rights Reserved.

```
    SUBTITLE                    "Constant Definitions"
;* * * *
```

-continued

Copyright 1997 © Amanda Refrigeration, Inc.
All Rights Reserved.

```
        errhi                           ;Total error between line and data
        errlo
    ENDC
;Overlapping variables
    CBLOCK slope
        t1                              ;Time for transducer ringing to decay
        t2                              ;Time between ringing and first echo
        t3                              ;Width of first echo pulse
        t4                              ;Time between first and second echoes
        alt_range                       ;Alternate ranging measurement
        alt_diff                        ;Difference using alt_range
        difference                      ;Difference between last two ranges
        distance                        ;Most likely ranging measurement
    ENDC
;Variable array for ranging data
prev_range              equ H'1F'
ranges                  equ (prev_range - 8)
;- - - -
```

-continued

Copyright 1997 © Amanda Refrigeration, Inc.
All Rights Reserved.

```
;* * * *
```

-continued

Copyright 1997 © Amanda Refrigeration, Inc.
All Rights Reserved.

```
    SET_FILE temp,8                     ;Set divide loop counter
    rlf lo,f
div_loop:
    rlf hi,f
    movf op1,w
    SKIP_LT_W hi
    movwf hi
    rlf lo,f                            ;Shift quotient bit into op1
    decfsz temp,f
    goto div_loop
div_done:
    retlw 0
;- - - -
```

-continued

Copyright 1997 © Amanda Refrigeration, Inc.
All Rights Reserved.

```
    goto R_start_second
    decf TMR0,w                         ;Record time between 1st and 2nd echo
    movwf t4
    retlw 0
;- - - -
```

-continued

Copyright 1997 © Amanda Refrigeration, Inc.
All Rights Reserved.

```
    call Get_Range_Timing
    ;Measure timing on echo pulse train (255=timeout)
    ; t1 = transducer's ringing time after initial pulse burst
    ; t2 = time between end of ringing and start of echo pulse
    ; t3 = width of echo pulse
    ; t4 = time between end of first echo and start of second echo
    clrf distance                   ;Assume no echo will be detected
    incf t1,w
    btfsc STATUS,Z                  ;Was an echo detected?
    retlw 1                         ;    No - No echo detected
    incf t2,w
    btfsc STATUS,Z
    retlw 1
    clrf hi                         ;Add t1 and t2
    movlw -ADJUSTMENT               ;    hi:lo = t1 + t2 - ADJUSTMENT
    addwf t1,w
    addwf t2,w
    movwf lo
    rlf hi,f
    movlw SMALL_WIDTH               ;If both t2 and t3 are small then a
    SKIP_LT_W t2                    ;    glitch probably occured
    goto R_no_glitch
    movlw SMALL_WIDTH
    SKIP_LT_W t3
    goto R_no_glitch
    incf t4,w                       ;Glitch was detected
    btfsc STATUS,Z                  ;    Was a second echo detected?
    retlw 1                         ;        No - Glitch without 2nd echo
    movf t3,w                       ;distance = hi:lo + t3+t4 - ADJUSTMENT
    addwf lo,f                      ;    hi:lo = hi:lo + t3 + t4
    btfsc STATUS,C
    incf hi,f
    movf t4,w
    addwf lo,f
    btfsc STATUS,C
    incf hi,f
R_no_glitch:
    COPY_FROM_TO lo,distance        ;    distance = hi:lo
    retlw 0
;- - - -
```

-continued

Copyright 1997 © Amanda Refrigeration, Inc.
All Rights Reserved.

```
    movlw H'FF'
OB_error:
    goto Write
;- - - -
```

-continued

Copyright 1997 © Amanda Refrigeration, Inc.
All Rights Reserved.

```
    movf slopef,w                   ;mxhi:mxlo = mxhi:mxlo - slope:slopef
    subwf mxlo,f
    btfss STATUS,C
    decf mxhi,f
    movf slope,w
    subwf mxhi,f
LSF_next_range2:                    ;Calculate error for this data point
    movf yint,w                      ;    W = y[i] - b
    subwf INDF,w
    addwf mxhi,w                     ;    W = W - m*X
    movwf op1                        ;Square the error for this data point
    btfss op1,7                      ;Is the error positive?
    goto LSF_positive_error          ;    Yes - Continue
    comf op1,f                       ;    No - Make it positive (op1 = -op1)
    incf op1,f
    movf op1,w
LSF_positive_error:
    movwf lo
    call Multiply                    ;    hi:lo = W * W
    movf lo,w                        ;Sum data point error to total error
    addwf errlo,f
    btfsc STATUS,C
    incf errhi,f
    movf hi,w
    addwf errhi,f
    incfsz FSR,f                     ;Process next data point's error
    goto LSF_next_mx
    retlw 0
;* * * *
```

-continued

Copyright 1997 © Amanda Refrigeration, Inc.
All Rights Reserved.

```
    btfsc hvin,RINSE                    ;Is RINSE input on?
    goto Rinse                          ;    Yes - Do rinse state
    SET_FILE PORTA,NO_STATE             ;    No - Show stand-by state
    SET_FILE statecnt,FILTER            ;Reset sampling filter
    goto main                           ;Repeat
;- - - -
```

-continued

Copyright 1997 © Amanda Refrigeration, Inc.
All Rights Reserved.

```
    goto delaying1
    SET_FILE PORTA,NO_STATE          ;Cause the LEDs to blink
    goto main
;- - - -
```

a circuit connected to said transceiver for amplifying and filtering said signal generated in response to each echo detected;

a edge detector connected to said circuit for detecting a sudden increase in said amplified and filtered signal and generating a ranging signal representing the time period between the transmittal of each of said plurality of ultrasonic pulses and the detection of each of said corresponding plurality of echoes; and a microprocessor for storing said ranging signals to form a signature, detecting at least one characteristic in said signature indicative of the optimum water height and in response to detecting said characteristic generating a signal to said control for stopping the water flow into said washing machine.

7. A water level detector as set forth in claim 6 wherein said microprocessor stores each ranging signal as a data point, calculates the best fit line through a set of said data points, calculates the slope of said best fit line and calculates the sum of the squares of the error distance that each data point in said set of data points is from said best fit line.

8. A water level detector as set forth in claim 7 wherein said characteristic comprises the sum of the squares being below a predetermined value.

9. A water level detector as set forth in claim 7 wherein said characteristic also comprises said slope of said best fit line being below a predetermined value.

10. A water level detector as set forth in claim 7 wherein said characteristic comprises the sum of the squares being below a predetermined value and said slope of said best fit line being below another predetermined value.

11. A method for automatically determining in real time when the water height in a washing machine reaches an optimum operating level and stopping the flow of the water into said washing machine when said optimum water level is reached, said washing machine having a tub for holding clothes to be cleaned and water, a control for beginning the flow of water into said tub and stopping the flow of water into said tub and a water level detector, said method comprising:

(a) beginning the flow of water into said tub;

(b) sending a plurality of ultrasonic pulses toward the water in said tub;

(c) detecting a plurality of echoes corresponding to said plurality of ultrasonic pulses;

(d) generating a plurality of signals, each corresponding to one of said plurality of detected echoes;

(e) storing each of said signals in a microprocessor;

(f) forming a set of data points corresponding to a set of said stored signals;

(g) calculating the best fit line for said set of data points;

(h) calculating the slope of said best fit line;

(i) calculating the sum of the squares of the distance each of said data points is from said best fit line;

(j) determining if said sum of the squares is below a predetermined value; and (k) stopping the flow of water to said tub if said sum of the squares is below a predetermined value.

12. The method as set forth in claim 11 comprising the following steps if said sum of the squares is above said predetermined value:

(l) adding another data point to said set of data points;

(m) removing the oldest data point from said set of data points; and (n) repeating steps g through k.

13. A method for automatically determining in real time when the water height in a washing machine reaches an optimum operating level and stopping the flow of the water into said washing machine when said optimum water level is reached, said washing machine having a tub for holding clothes to be cleaned and water, a control for beginning the flow of water into said tub and stopping the flow of water into said tub and a water level detector, said method comprising:

(a) beginning the flow of water into said tub;

(b) sending a plurality of ultrasonic pulses toward the water in said tub;

(c) detecting a plurality of echoes corresponding to said plurality of ultrasonic pulses;

(d) generating a plurality of signals, each corresponding to one of said plurality of detected echoes;

(e) storing each of said signals in a microprocessor;

(f) forming a set of data points corresponding to a set of said stored signals;

(g) calculating the best fit line for said set of data points;

(h) calculating the slope of said best fit line;

(i) determining if said slope of said best fit line is below a predetermined value; and (j) stopping the flow of water to said tub if said slope is below a said predetermined value.

14. The method as set forth in claim 13 comprising the following steps if said slope is above said predetermined value:

(k) adding another data point to said set of data points;

(l) removing the oldest data point from said set of data points; and (m) repeating steps g through j.

15. A method for automatically determining in real time when the water height in a washing machine reaches an optimum operating level and stopping the flow of the water into said washing machine when said optimum water level is reached, said washing machine having a tub for holding clothes to be cleaned and water, a control for beginning the flow of water into said tub and stopping the flow of water into said tub and a water level detector, said method comprising:

(a) beginning the flow of water into said tub;

(b) sending a plurality of ultrasonic pulses toward the water in said tub;

(c) detecting a plurality of echoes corresponding to said plurality of ultrasonic pulses;

(d) generating a plurality of signals, each corresponding to one of said plurality of detected echoes;

(e) storing each of said signals in a microprocessor;

(f) forming a set of data points corresponding to a set of said stored signals;

(g) calculating the best fit line for said set of data points;

(h) calculating the slope of said best fit line;

(i) calculating the sum of the squares of the distance each of said data points is from said best fit line;

(j) determining if said sum of the squares is below a predetermined value;

(k) if said sum of the squares is below said predetermined value, determining if said slope of said best fit line is below another predetermined value;

(l) stopping the flow of water to said tub if said slope is below said another predetermined value.

16. The method as set forth in claim 15 comprising the following steps if said sum of the squares is above said predetermined value:

(m) adding another data point to said set of data points;

(n) removing the oldest data point from said set of data points; and (o) repeating steps g through l.

17. The method as set forth in claim 16 comprising the following steps if said slope is above said another predetermined value:

(p) adding another data point to said set of data points;

(q) removing the oldest data point from said set of data points; and (r) repeating steps g through l.

18. A water level detector for automatically determining in real time when the water height in a washing machine reaches an optimum operating level, said washing machine having a control for beginning and stopping water flow into said washing machine, said detector comprising:

a first circuit for sending a plurality of ultrasonic pulses, detecting a corresponding plurality of echoes and generating a ranging signal representing the time period between the transmittal of each of said plurality of ultrasonic pulses and the detection of each of said corresponding plurality of echoes, and a microprocessor for storing said ranging signals to form a signature, detecting at least one characteristic in said signature indicative of the optimum water height and in response to detecting said characteristic generating a signal to said control for stopping the water flow into said washing machine.

19. A water level detector as set forth in claim 18 wherein said microprocessor stores each signal as a data point, calculates the best fit line through a set of said data points, calculates the slope of said best fit line and calculates the sum of the squares of the error distance that each data point in said set of data points is from said best fit line.

20. A water level detector as set forth in claim 19 wherein said characteristic comprises the sum of the squares being below a predetermined value.

21. A water level detector as set forth in claim 19 wherein said characteristic comprises said slope of said best fit line being below a predetermined value.

22. A water level detector as set forth in claim 19 wherein said characteristic comprises the sum of the squares being below a predetermined value and said slope of said best fit line being below another predetermined value.

23. A water level detector as set forth in claim 19 wherein said circuit comprises:

a transceiver for sending a plurality of ultrasonic pulses, detecting a plurality of echoes and generating a signal in response to each echo detected; and a second circuit for receiving said signal and generating said ranging signal.

* * * * *